US007453311B1

(12) United States Patent
Hart et al.

(10) Patent No.: US 7,453,311 B1
(45) Date of Patent: Nov. 18, 2008

(54) METHOD AND APPARATUS FOR COMPENSATING FOR PROCESS VARIATIONS

(75) Inventors: Michael L. Hart, Palo Alto, CA (US); Patrick Quinn, Chapelizod (IE); Jan L. de Jong, Cupertino, CA (US)

(73) Assignee: Xilinx, Inc., San Jose, CA (US)

( * ) Notice: Subject to any disclaimer, the term of this patent is extended or adjusted under 35 U.S.C. 154(b) by 403 days.

(21) Appl. No.: 11/016,657

(22) Filed: Dec. 17, 2004

(51) Int. Cl.
*G05F 1/10* (2006.01)

(52) U.S. Cl. ..... 327/534

(58) Field of Classification Search ..... 327/530, 327/534, 535, 513, 525
See application file for complete search history.

(56) References Cited

U.S. PATENT DOCUMENTS 6,272,666 B1 * 8/2001 Borkar et al. ..... 716/5
6,333,571 B1 * 12/2001 Teraoka et al. ..... 307/125
6,388,483 B1 * 5/2002 Mizuno et al. ..... 327/158
6,753,719 B2 * 6/2004 Bhagavatheeswaran et al. ..... 327/534
6,774,705 B2 * 8/2004 Miyazaki et al. ..... 327/534
6,867,637 B2 * 3/2005 Miyazaki et al. ..... 327/534
6,917,237 B1 * 7/2005 Tschanz et al. ..... 327/513
6,943,613 B2 * 9/2005 Miyazaki et al. ..... 327/534
7,109,782 B2 * 9/2006 Kase ..... 327/534
7,196,571 B2 * 3/2007 Sumita ..... 327/534
7,250,807 B1 * 7/2007 Doyle ..... 324/534
2006/0020838 A1 * 1/2006 Tschanz et al. ..... 713/322

* cited by examiner

*Primary Examiner*—Jeffrey S Zweizig
(74) *Attorney, Agent, or Firm*—William L. Paradice, III; Kin-Wah Tong

(57) ABSTRACT

A method and apparatus compensate for process variations in the fabrication of semiconductor devices. A semiconductor device includes a control circuit that measures a performance parameter of the device, and in response thereto selectively biases one or more well regions of the device to compensate for process variations. For some embodiments, if measurement of the performance parameter indicates that the device does not fall within a specified range of operating parameters, the control circuit biases selected well regions to sufficiently alter the operating characteristics of transistors formed therein so that the device falls within the specified range of operating parameters.

33 Claims, 9 Drawing Sheets

METHOD AND APPARATUS FOR COMPENSATING FOR PROCESS VARIATIONS

FIELD OF INVENTION

The present invention relates generally to integrated circuits, and more specifically to improving specified performance characteristics over process variations.

DESCRIPTION OF RELATED ART

FIG. 1 shows an exemplary system 100 in which an NMOS pass transistor 120 coupled between a first logic element 110*a* and a second logic element 110*b* has a gate to receive a gate voltage Vg. Referring also to FIG. 2, transistor 120 includes an n+ type source region 121 and an n+ type drain region 122 formed in a suitable p− type substrate 123 with a channel region 124 extending between source 121 and drain 122. A gate 125 formed of a suitable material such as polysilicon is insulated from substrate 123 by a layer of gate oxide 126. When the voltage applied between gate 125 and source 121 (Vgs) exceeds the threshold voltage (VT) of transistor 120, transistor 120 turns on and can pass signals between logic elements 110*a* and 110*b*. Conversely, when Vgs is less than VT, transistor 120 is non-conductive and does not pass signals between logic elements 110*a* and 110*b*.

Process variations inherent in the fabrication of semiconductor devices often cause devices having the same design to behave differently. For example, limitations of present photolithography techniques often result in transistors of the same design to have different gate lengths, which typically leads to variations in transistor operating characteristics. More specifically, transistors such as transistor 120 that, due to process variations, have a shorter than nominal gate length typically have a lower VT than nominal transistors because of the well-known short channel effect. Although a lower VT typically results in faster transistor switching speeds and thus smaller transistor propagation delays, the lower VT also results in larger transistor leakage currents, which in turn increases power consumption and may decrease reliability.

FIG. 3 shows an exemplary plot comparing the leakage current versus gate voltage characteristics of a nominal gate length transistor and a short gate length transistor. The solid line depicts the relationship between gate voltage and the drain-to-source current (Ids) for a transistor having a nominal gate length and the dashed line depicts the relationship between gate voltage and Ids for a transistor having a short gate length. The value of Ids when the gate voltage is zero, e.g., when the transistor is in an off state, represents the leakage current (I_off) of the transistor. Thus, as depicted in FIG. 3, the leakage current I_off(sce) for a short channel transistor is significantly higher than the leakage current I_off (nom) for a transistor having a nominal gate length. Indeed, for NMOS transistors having a VT of approximately 0.3 volts, process variations inherent in modern semiconductor fabrication techniques may inadvertently reduce VT by as much as 100 mV. For example, because each 60-90 mV reduction in VT typically results in approximately a decade increase in leakage current, transistors having a short channel may have a leakage current an order of magnitude greater than the leakage current of transistors having a nominal gate length.

Because process variations may result in significant operating characteristic variations between semiconductor devices of the same design, most IC manufacturers specify a range of operating characteristics for their devices. For example, FIG. 4 illustrates an exemplary distribution of a plurality of devices of the same design with respect to the well-known relationship between leakage current (Icc) and propagation delay (D) that typifies modern semiconductor devices. As known in the art, devices having short channel transistors are typically faster than nominal devices and typically exhibit larger leakage currents than nominal devices. Conversely, devices having long channel transistors are typically slower than nominal devices and typically exhibit smaller leakage currents than nominal devices. Thus, IC manufacturers typically identify a device in the middle of the process distribution and select its propagation delay and corresponding leakage current as a nominal propagation delay and a nominal leakage current, respectively, for the devices and then select a range of process that includes as many devices as possible (e.g., to maximize manufacturing yield) while maintaining an acceptable range of operating characteristics (e.g., to provide some level of performance accuracy to customers).

For example, an IC manufacturer may specify a range of operating parameters by selecting a maximum leakage current Icc(max) and a maximum propagation delay D(max) for the devices, where Icc(max) corresponds to a minimum propagation delay D(min) and D(max) corresponds to a minimum leakage current Icc(min). Thereafter, devices that fall within the specified range of operating parameters, such as the devices represented by "•" in FIG. 4, are deemed acceptable and may be shipped to customers, and devices that do not fall within the specified range of operating parameters, such as the fast devices represented by "x" in FIG. 4 and the slow devices represented by "*" in FIG. 4, are deemed unacceptable and may not be shipped to customers. The fast devices represented by "x" are typically discarded because their leakage current exceeds Icc(max), and the slow devices represented by "*" are typically discarded because their propagation delay exceeds D(max).

As indicated by the device distribution plot of FIG. 4, selecting a range of operating parameters for an IC device involves a balance between manufacturing yield and performance accuracy. Thus, although yield may be improved by expanding the specified range of operating parameters to include more devices, expanding the range of operating parameters not only decreases performance accuracy but may also degrade the nominal operating parameters for the device. For example, although yield may be improved by increasing the maximum specified propagation delay to include some of the otherwise discarded slow devices, the nominal propagation delay of the devices is also increased, which undesirably reduces the nominal operating frequency of the devices. Further, although performance accuracy may be improved by narrowing the specified range of operating parameters, manufacturing yield is undesirable reduced.

Therefore, there is a need to improve the specified range of operating parameters for an IC device without degrading manufacturing yield.

SUMMARY

A method and apparatus are disclosed that compensate for process variations in the fabrication of semiconductor devices. In accordance with the present invention, a control circuit is provided that measures a performance parameter of the device, and in response thereto selectively biases one or more well regions of the device to alter the operating characteristics of transistors formed in the well regions so that the device falls within a specified range of operating parameters. The measured performance parameter, which may be any suitable parameter that indicates whether the device falls within the specified range of operating parameters, may include, for example, the device's leakage current, a propagation delay along a selected path of the device, the device's operating frequency, the device's operating temperature, and the like.

For some embodiments, if measurement of the performance parameter indicates that the device does not fall within the specified range of operating parameters, the control circuit may sufficiently bias the well regions to change the threshold voltage of the transistors formed therein so that the device falls within the specified range of operating parameters. For example, if the device is a fast device having a leakage current that exceeds the maximum specified leakage current, the control circuit may bias the well regions with a voltage of a first polarity to increase the transistors' threshold voltage and thus reduce the leakage current to a level that falls within the specified range of operating parameters, thereby recovering the fast device. Conversely, if the device is a slow device having a propagation delay that exceeds the maximum specified propagation delay, the control circuit may bias the well regions with a voltage of a second polarity (typically opposite the first polarity) to decrease the transistors' threshold voltage and thus reduce the propagation delay to a level that falls within the specified range of operating parameters, thereby recovering the slow device. For one embodiment, if measurement of the performance parameter indicates that the device falls within the specified range of operating parameters, the control circuit may not bias the well regions. For other embodiments, the control circuit may be configured to adjust a bias voltage provided to the device's well regions in response to the measured performance parameter, for example, according to a predetermined relationship between the performance parameter and the bias voltage. Further, for other embodiments, the control circuit may provide the bias voltage to one or more selected well regions of the device in response to one or more corresponding select signals.

The ability to modify the operating characteristics of a device's transistors to recover fast and/or slow devices that would otherwise be discarded may allow an IC manufacturer to narrow the device's specified range of operating parameters, increase manufacturing yield, and/or improve the device's nominal (e.g., average) operating parameters.

BRIEF DESCRIPTION OF THE DRAWINGS

The features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION

Embodiments of the present invention are described below in the context of a semiconductor device having one or more p-well regions housing any number of NMOS transistors for simplicity only. It is to be understood that present embodiments are equally applicable to biasing one or more n-well regions housing any number of PMOS transistors. In the following description, for purposes of explanation, specific nomenclature is set forth to provide a thorough understanding of the present invention. In other instances, well-known circuits and devices are shown in block diagram form to avoid obscuring the present invention unnecessarily. Further, the logic levels assigned to various signals in the description below are arbitrary, and therefore may be modified (e.g., reversed polarity) as desired. Accordingly, the present invention is not to be construed as limited to specific examples described herein but rather includes within its scope all embodiments defined by the appended claims.

Figure 1:
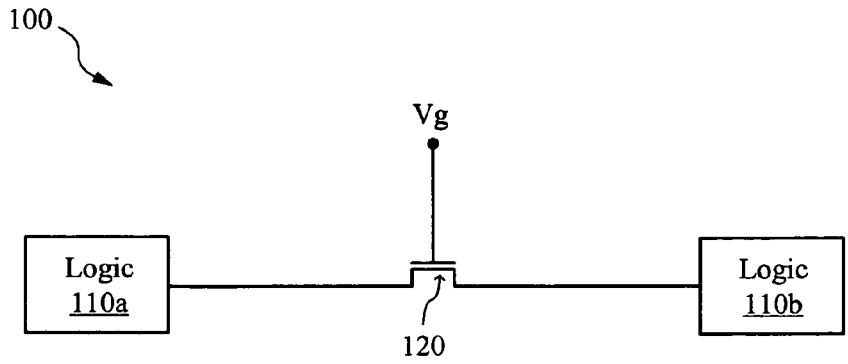
FIG. 1 (prior art)
FIG. 1 is a block diagram showing an NMOS pass transistor coupled between two logic elements.
Figure 2:
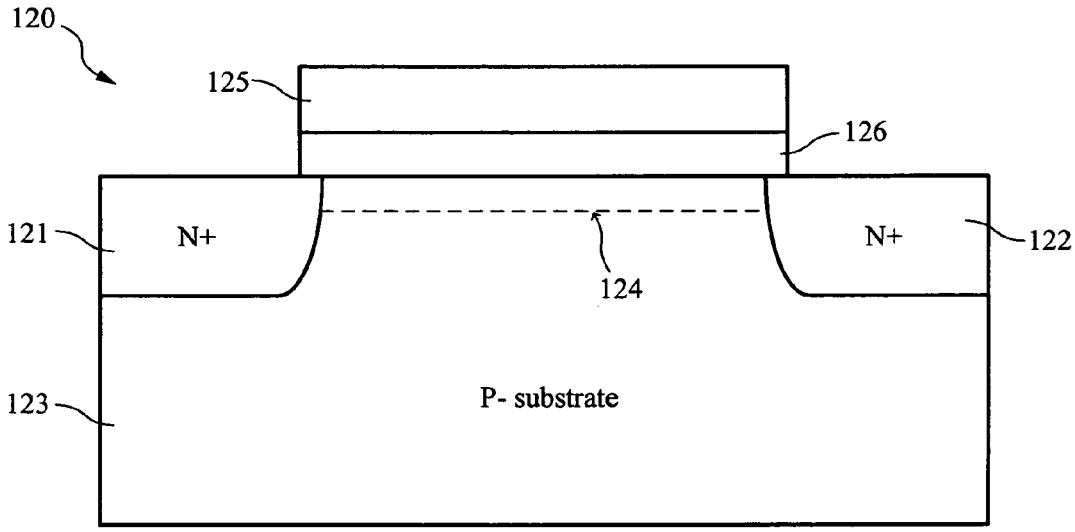
FIG. 2 (prior art)
FIG. 2 is an illustrative cross-sectional diagram of the transistor of FIG. 1.
Figure 3:
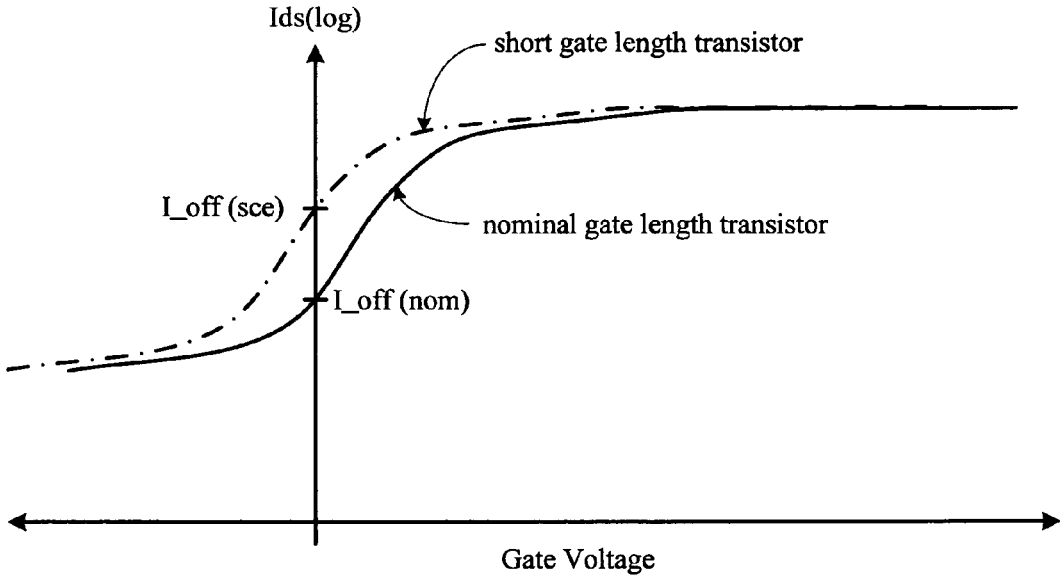
FIG. 3 is an exemplary plot generally representative of the relationship between transistor gate voltage and leakage current, wherein the leakage current is represented on a logarithmic scale.
Figure 5:
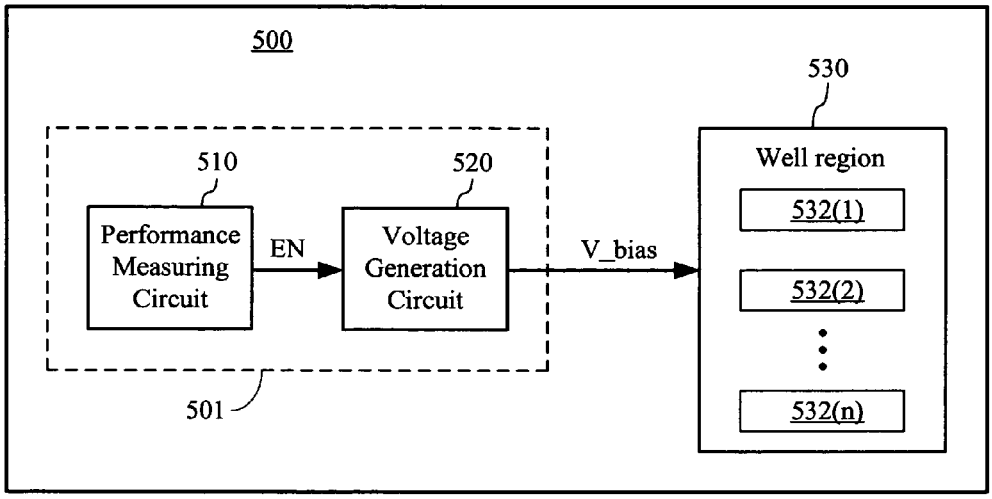
FIG. 5 is a block diagram of a device having a control circuit configured to selectively bias one or more well regions in accordance with one embodiment of the present invention.

FIG. 5 is a block diagram of a semiconductor device 500 having a control circuit 501 configured in accordance with one embodiment of the present invention to compensate for process variations inherent in the fabrication of semiconductor devices. Device 500, which may be any suitable semiconductor device such as a programmable logic device (PLD), also includes a p-well region 530 housing a plurality of NMOS transistors 532(1)-532(*n*). For simplicity, only one well region 530 is shown in FIG. 5. However, for other embodiments, device 500 may include any number of well regions 530. Transistors 532, which may be any well-known NMOS transistor device such as transistor 120 of FIG. 2, may perform any suitable function and/or may form any suitable circuit element. For example, transistors 532 may be pass or select transistors, and/or may form more complex circuits such as logic gates, registers, latches, processors, configurable logic blocks in a PLD, and the like. For other embodiments, transistors 532 may be floating gate transistors used to form well-known non-volatile memory elements such as EPROM, EEPROM, and/or Flash memory cells.

In accordance with the present invention, control circuit 501 is configured to selectively bias well region 530 in response to one or more measured performance parameters of device 500 to compensate for process variations inherent in the fabrication of device 500. Control circuit 501 is shown in FIG. 5 as including a performance measuring circuit 510 and a voltage generation circuit 520. Performance measuring circuit 510 measures a performance parameter of device 500, and in response thereto generates an enable signal (EN). Voltage generation circuit 520 includes an input to receive EN and includes an output to selectively provide a bias voltage (V_bias) to well region 530 in response to EN. For some embodiments, performance measuring circuit 510 asserts EN if device 500 is not within a specified range of operating parameters, which causes voltage generation circuit 520 to provide V_bias to well region 530, thereby altering the operating characteristics of transistors 532 so that the device falls within the specified range of operating parameters. Conversely, performance measuring circuit 510 de-asserts EN if device 500 falls within the specified range of operating parameters, which causes voltage generation circuit 520 to not provide V_bias to well region 530. The bias voltage provided to well region 530 by control circuit 501 may be any predetermined positive or negative voltage suitable for the process geometry employed to fabricate device 500, or may be a variable voltage based on a measurement by performance measuring circuit 510. In general, enable signal EN may be a single bit signal or a multi-bit signal. In embodiments with a multi-bit enable signal, the bits of the signal may indicate whether a positive or a negative bias voltage should be made, and may indicate the magnitude of such bias voltage, based on the values measured by the performance measuring circuit. For instance, the magnitude of the bias voltage provided may increase based on how far the device is outside the specified range of operating parameters. In some embodiments, the relationship between the measured performance parameter and the bias voltage may be stored in a memory or a look-up table.

Figure 6:
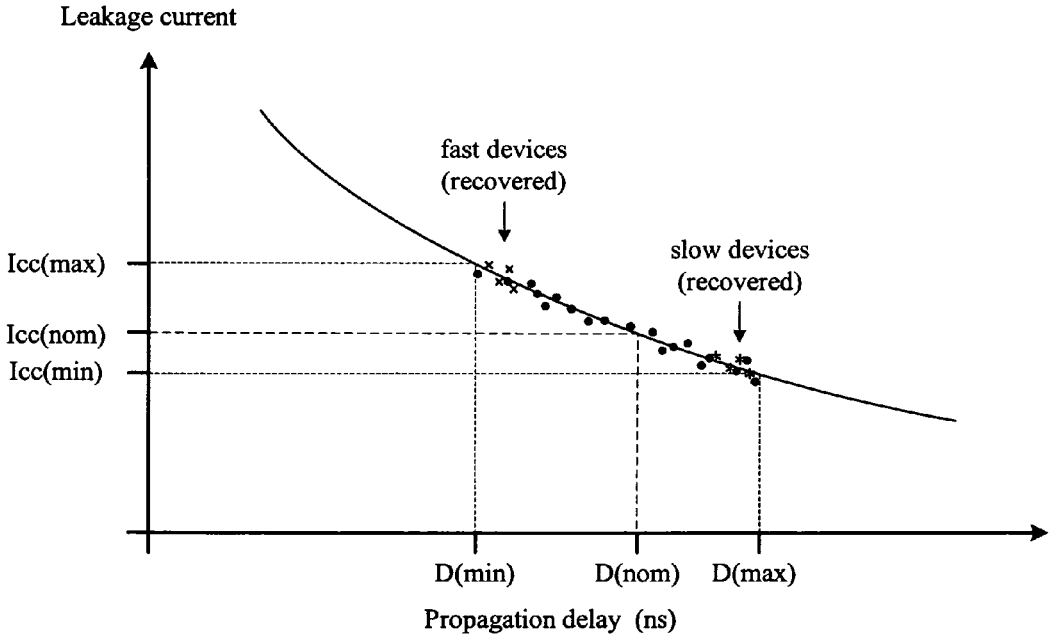
FIG. 6 is an exemplary distribution plot illustrating the recovery of fast and slow devices in accordance with the present invention.

More specifically, by selectively providing a bias voltage to well region 530, control circuit 501 may offset transistor VT variations between devices of the same design resulting from process variations inherent in the fabrication of semiconductor devices, which in turn may allow the operating characteristics of fast and/or slow devices that would normally be discarded for failing to meet a specified range of operating parameters to be sufficiently altered so that the devices will fall within the specified range of operating parameters. For example, referring also to FIG. 4, control circuit 501 may provide a negative bias voltage to the well regions 530 of the fast devices indicated by "x" to reduce the leakage current to a level that is less than the maximum specified leakage current Icc(max) by sufficiently increasing the VT of transistors 532. Conversely, control circuit 501 may provide a positive bias voltage to the well regions 530 of the slow devices indicated by "*" to reduce the propagation delay to a level that is less than the maximum specified propagation delay D(max) by sufficiently decreasing the VT of transistors 532. In this manner, present embodiments may recover the fast and slow devices indicated by "x" and "*", respectively, as illustrated in FIG. 6, by altering the operating characteristics of the transistors formed therein.

Figure 4:
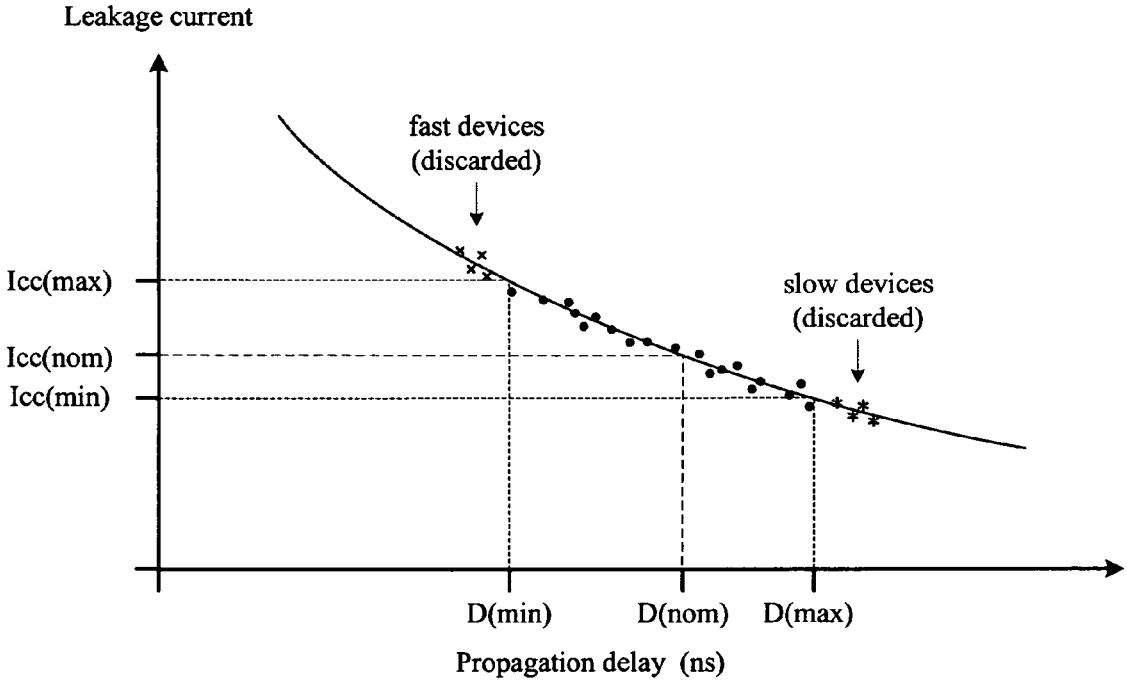
FIG. 4 illustrates an exemplary distribution of devices having the same design with respect to a typical relationship between transistor leakage current and propagation delay.

The ability to alter transistor operating characteristics to recover the fast and/or slow devices that would normally be discarded may increase the number of devices that fall within the specified range of operating parameters, thereby advantageously increasing manufacturing yield. Further, by altering the process distribution of semiconductor devices, as depicted by a comparison of the process distribution plots of FIGS. 4 and 6, present embodiments may allow the range of operating parameters for a semiconductor device to be narrowed without significantly reducing manufacturing yield, which in turn may also improve the specified nominal operating parameters for the devices.

For semiconductor devices which already include circuitry such as performance measuring circuit 510 that determines whether the devices fall within the specified range of process, embodiments of the present invention may be implemented using minimal resources. For example, the Virtex family of FPGA products available from Xilinx, Inc. typically includes an embedded tool commonly known as the Process Monitoring Vehicle (PMV) that measures device propagation delays as a function of leakage current. For such embodiments, the PMV may operate as performance measuring circuit 510 of control circuit 501. In general, it may be preferable to use a well-characterized and uniform performance measuring circuit, such as the PMV, in order to ensure a strong correlation with design parameters and thus achieve consistent results.

Performance measuring circuit 510 may be configured using well-known techniques to measure any suitable performance parameter of device 500 to determine whether device 500 falls within the specified range of operating parameters. For some embodiments, the performance of device 500 is determined by measuring the device's DC standby current (e.g., transistor leakage current) as a function of propagation delay, for example, as depicted in the exemplary distribution plot of FIG. 6.

Figure 7A:
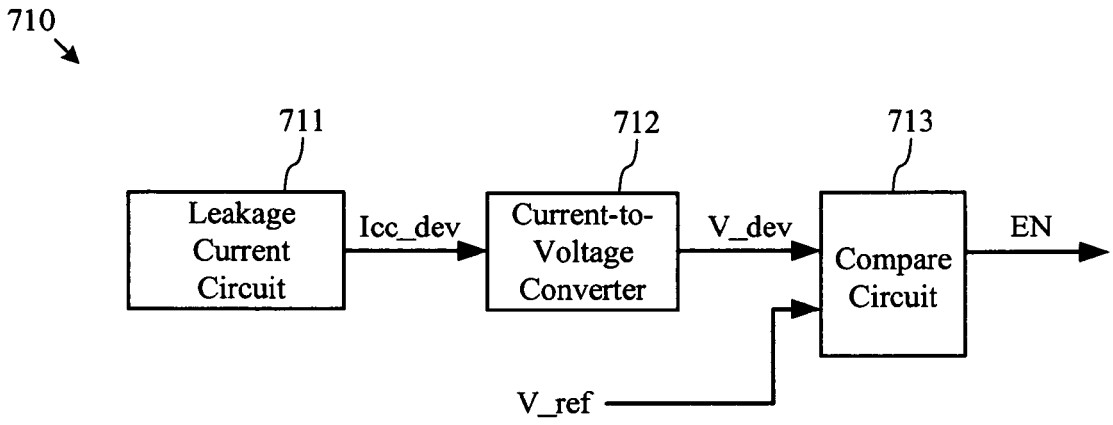
FIGS. 7A-7E are block diagrams of various embodiments of the performance measuring circuit of FIG. 5.

Thus, for first embodiments, performance measuring circuit 510 may be configured to measure the leakage current in device 500 to determine whether to bias well region 530. For example, FIG. 7A shows a performance measuring circuit 710 that is one embodiment of performance measuring circuit 510. Performance measuring circuit 710 includes a leakage current circuit 711, a current-to-voltage converter circuit 712, and a compare circuit 713. Leakage current circuit 711 may be any well-known circuit that generates an output current (Icc_dev) indicative of device 500's leakage current. Converter circuit 712, which is well-known, includes an input to receive Icc_dev and includes an output to generate a voltage signal (V_dev) relative or proportional to Icc_dev. Compare circuit 713, which is well-known, includes a first input to receive V_dev, a second input to receive a reference voltage V_ref, and an output to generate EN.

The reference voltage V_ref, which may be generated using well-known circuitry, is compared with V_dev via compare circuit 713 to selectively assert EN. For some embodiments, V_ref is set to a value that corresponds to a maximum leakage current specified for device 500, and voltage generation circuit 520 (see also FIG. 5) is configured to selectively generate a negative bias voltage in response to EN. For example, if V_dev is greater than V_ref, which indicates that device 500 is a fast device having a leakage current greater than the maximum specified leakage current, compare circuit 713 asserts EN to cause voltage generation circuit 520 to bias well region 530 with a negative voltage to reduce its leakage current. Conversely, if V_dev is less than V_ref, which may indicate that device 500 falls within the specified range of operating parameters, compare circuit 713 de-asserts EN to cause voltage generation circuit 520 to not bias well region 530.

For other embodiments, V_ref may be set to a value that corresponds to a leakage current associated with a maximum propagation delay for device 500 (e.g., according to the distribution plot of FIG. 6), and voltage generation circuit 520 may be configured to selectively generate a positive bias voltage in response to EN. For example, if V_dev is less than V_ref, which indicates that device 500 is a slow device having a propagation delay greater than a maximum specified propagation delay, compare circuit 713 asserts EN to cause voltage generation circuit 520 to bias well region 530 with a positive voltage reduce its propagation delay. Conversely, if V_dev is greater than V_ref, which may indicate that device 500 falls within the specified range of operating parameters, compare circuit 713 de-asserts EN to cause voltage generation circuit 520 to not bias well region 530.

Figure 7B:
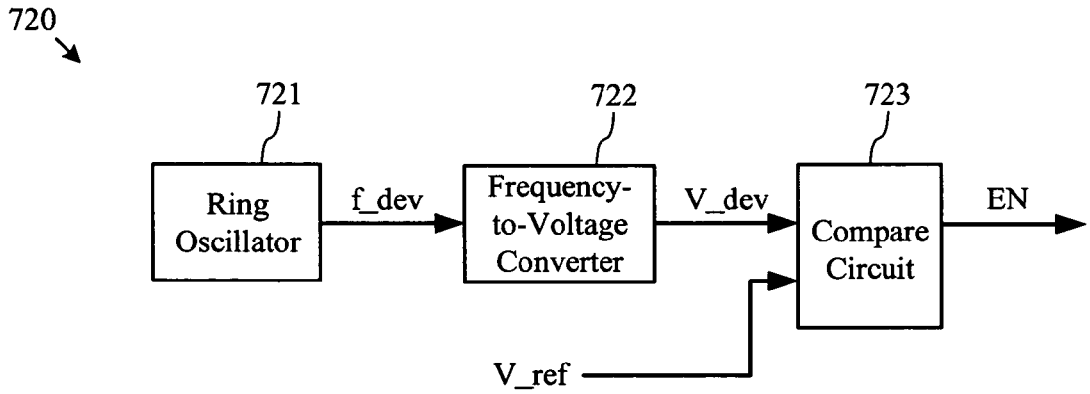

For second embodiments, performance measuring circuit 510 may be configured to measure the operating frequency of device 500 to determine whether to bias well region 530. For example, FIG. 7B shows a performance measuring circuit 720 that is another embodiment of performance measuring circuit 510. Performance measuring circuit 720 includes a ring oscillator 721, a frequency-to-voltage converter circuit 722, and a compare circuit 723. Ring oscillator 721, which may be any well-known oscillator such as an inverter ring oscillator, generates an output signal (f_dev) indicative of the operating frequency of device 500. For some embodiments, ring oscillator 721 generates an output frequency signal that is temperature-independent, for example, by employing well-known bandgap reference circuits to compensate for temperature variations. Converter circuit 722, which is well-known, includes an input to receive f_dev and includes an output to generate a voltage signal (V_dev) relative or proportional to f_dev. Compare circuit 723, which is well-known, includes a first input to receive V_dev, a second input to receive a reference voltage (V_ref), and an output to generate EN.

The reference voltage V_ref, which may be generated using well-known circuitry, is compared with V_dev via compare circuit 723 to selectively assert EN. For some embodiments, V_ref is set to a value that corresponds to an operating frequency associated with a maximum leakage current specified for device 500, and voltage generation circuit 520 is configured to selectively generate a negative bias voltage in response to EN. For example, if V_dev is greater than V_ref, which indicates that device 500 is a fast device having a leakage current greater than the maximum specified leakage current, compare circuit 723 asserts EN to cause voltage generation circuit 520 to bias well region 530 with a negative voltage to reduce its leakage current. Conversely, if V_dev is less than V_ref, which may indicate the device 500 falls within the specified range of operating parameters, compare circuit 723 de-asserts EN to cause voltage generation circuit 520 to not bias well region 530.

For other embodiments, V_ref may be set to a value that corresponds to a minimum operating frequency for device 500, and voltage generation circuit 520 may be configured to selectively generate a positive bias voltage in response to EN. For example, if V_dev is less than V_ref, which indicates that device 500 is a slow device, compare circuit 723 asserts EN to cause voltage generation circuit 520 to bias well region 530 with a positive voltage to increase its operating frequency. Conversely, if V_dev is greater than V_ref, which may indicate that device 500 falls within the specified range of operating parameters, compare circuit 723 de-asserts EN to cause voltage generation circuit 520 to not bias well region 530.

Figure 7C:
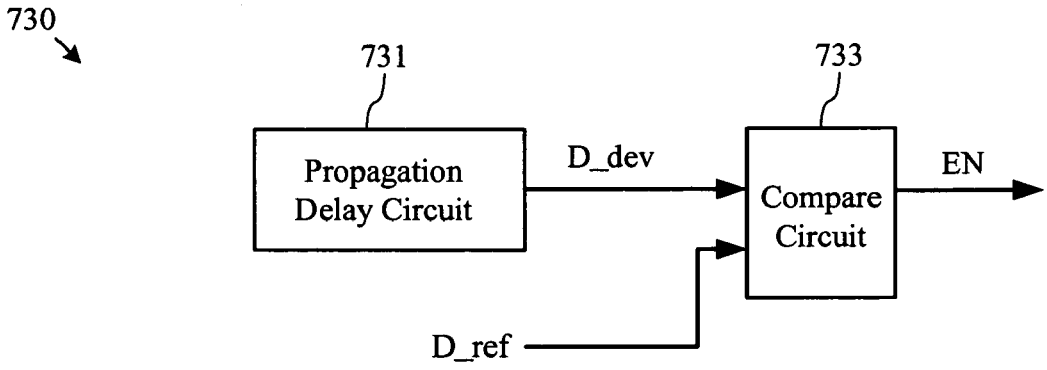

For third embodiments, performance measuring circuit 510 may be configured to measure a propagation delay of device 500 to determine whether to bias well region 530. For example, FIG. 7C shows a performance measuring circuit 730 that is yet another embodiment of performance measuring circuit 510. Performance measuring circuit 730 includes a propagation delay circuit 731 and a compare circuit 733. Propagation delay circuit 731 may be any well-known circuit that measures the propagation delay along a selected path of device 500 and generates an output signal (D_dev) indicative of the measured propagation delay. Compare circuit 733, which is well-known, includes a first input to receive D_dev, a second input to receive a reference delay signal (D_ref), and an output to generate EN.

The reference delay signal D_-ref, which may be generated using well-known circuitry, is compared with D_dev via compare circuit 733 to selectively assert EN. For some embodiments, D_ref is set to a value that corresponds to a propagation delay associated with a maximum leakage current specified for device 500, and voltage generation circuit 520 is configured to selectively generate a negative bias voltage in response to EN. For example, if D_dev is less than D_ref, which indicates that device 500 is a fast device having a leakage current greater than the maximum specified leakage current, compare circuit 733 asserts EN to cause voltage generation circuit 520 to bias well region 530 with a negative voltage to reduce its leakage current. Conversely, if D_dev is greater than D_ref, which may indicate that device 500 falls within the specified range of operating parameters, compare circuit 733 de-asserts EN to cause voltage generation circuit 520 to not bias well region 530.

For other embodiments, D_ref may be set to a value that indicates a maximum propagation delay for device 500, and voltage generation circuit 520 may be configured to selectively generate a positive bias voltage in response to EN. For example, if D_dev is greater than D_ref, which indicates that device 500 is a slow device, compare circuit 733 asserts EN to cause voltage generation circuit 520 to bias well region 530 with a positive voltage to reduce its propagation delay. Conversely, if D_dev is less than D_ref, which may indicate that device 500 falls within the specified range of operating parameters, compare circuit 733 de-asserts EN to cause voltage generation circuit 520 to not bias well region 530.

For still other embodiments, performance measuring circuit 730 may include a well-known conversion circuit (not shown for simplicity) having an input to receive D_dev and having an output to generate a voltage signal relative or proportional to D_dev. For such embodiments, compare circuit 733 has a first input coupled to the output of the conversion circuit, a second input to receive a reference voltage indicative of some predetermined propagation delay, and an output to generate EN.

Figure 7D:
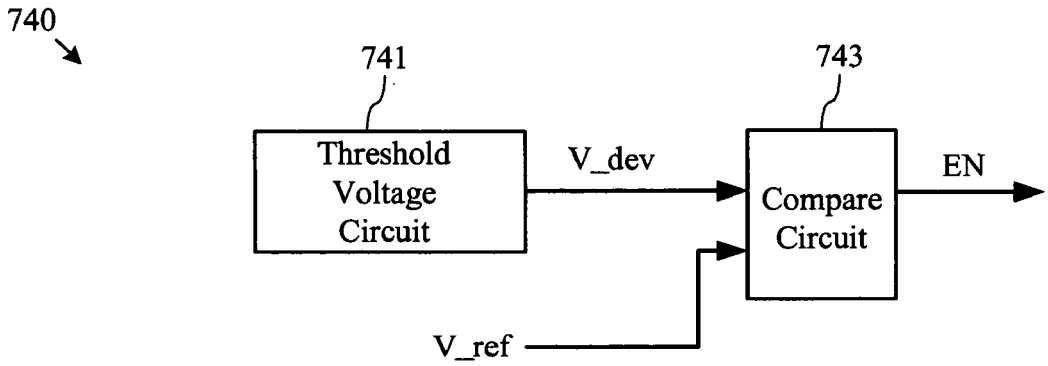

For fourth embodiments, performance measuring circuit 510 may be configured to measure the threshold voltage of one or more selected transistors within device 500 to determine whether to bias well region 530. For example, FIG. 7D shows a performance measuring circuit 740 that is yet another embodiment of performance measuring circuit 510. Performance measuring circuit 740 includes a threshold voltage circuit 741 and a compare circuit 743. Threshold voltage circuit 741 may be any well-known circuit that measures the threshold voltage of one or more selected transistors in device 500 and generates an output signal (V_dev) indicative of the measured threshold voltage. Compare circuit 743, which is well-known, includes a first input to receive V_dev, a second input to receive a reference voltage signal (V_ref), and an output to generate EN.

The reference voltage signal V_ref, which may be generated using well-known circuitry, is compared with V_dev via compare circuit 743 to selectively assert EN. For some embodiments, V_ref is set to a value that corresponds to a minimum threshold voltage for the device's transistors, and voltage generation circuit 520 is configured to selectively generate a negative bias voltage in response to EN. For example, if V_dev is less than V_ref, which indicates that device 500 is a fast device having transistors with a threshold voltage less than a minimum value, compare circuit 743 asserts EN to cause voltage generation circuit 520 to bias well region 530 with a negative voltage to increase the threshold voltage of the device's transistors. Conversely, if V_dev is greater than V_ref, which may indicate that device 500 falls within the specified range of operating parameters, compare circuit 743 de-asserts EN to cause voltage generation circuit 520 to not bias well region 530.

For other embodiments, V_ref may be set to a maximum threshold voltage for the device's transistors, and voltage generation circuit 520 may be configured to selectively generate a positive bias voltage in response to EN. For example, if V_dev is greater than V_ref, which indicates that device 500 is a slow device having transistors with a threshold voltage greater than a maximum value, compare circuit 743 asserts EN to cause voltage generation circuit 520 to bias well region 530 with a positive voltage to reduce the threshold voltage of the device's transistors. Conversely, if V_dev is less than V_ref, which may indicate that device 500 falls within the specified range of operating parameters, compare circuit 743 de-asserts EN to cause voltage generation circuit 520 to not bias well region 530.

Figure 7E:
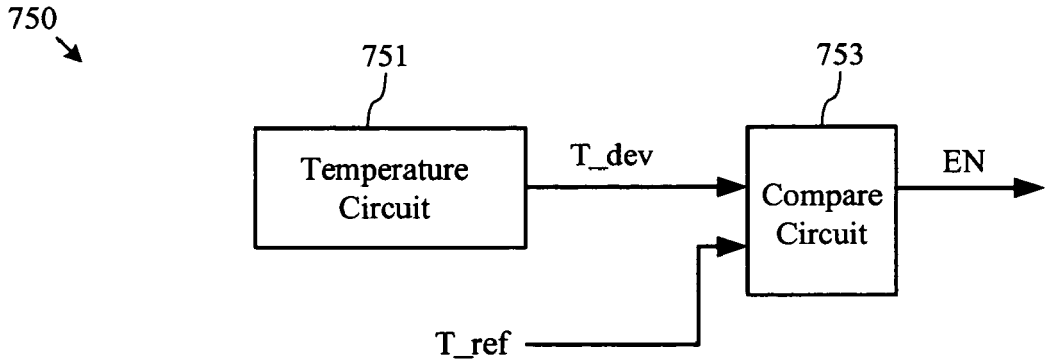

For fifth embodiments, performance measuring circuit 510 may be configured to measure the operating temperature at one or more selected locations within device 500 to determine whether to bias well region 530. As is well-known, temperature may affect the performance of transistors. In particular, a low temperature may result in fast transistors and a high temperature may result in slow transistors. For example, FIG. 7E shows a performance measuring circuit 750 that is yet another embodiment of performance measuring circuit 510. Performance measuring circuit 750 includes a temperature circuit 751 and a compare circuit 753. Temperature circuit 751 may be any well-known circuit, such as a temperature diode, that measures the temperature at one or more locations in device 500 and generates an output signal (T_dev) indicative of the measured temperature. Compare circuit 753, which is well-known, includes a first input to receive T_dev, a second input to receive a reference temperature signal (T_ref), and an output to generate EN.

The reference temperature signal T_ref, which may be generated using well-known circuitry, is compared with T_dev via compare circuit 753 to selectively assert EN. For some embodiments, T_ref is set to a value that corresponds to a minimum temperature for the device's transistors, and voltage generation circuit 520 is configured to selectively generate a negative bias voltage in response to EN. For example, if T_dev is less than T_ref, which indicates that transistors of device 500 will be fast, compare circuit 753 asserts EN to cause voltage generation circuit 520 to bias well region 530 with a negative voltage to increase the threshold voltage of the device's transistors. Conversely, if T_dev is greater than T_ref, which may indicate that device 500 falls within the specified range of operating temperatures, compare circuit 753 de-asserts EN to cause voltage generation circuit 520 to not bias well region 530.

For other embodiments, T_ref may be set to a maximum temperature for the device, and voltage generation circuit 520 may be configured to selectively generate a positive bias voltage in response to EN. For example, if T_dev is greater than T_ref, which indicates that transistors of device 500 will be slow, compare circuit 753 asserts EN to cause voltage generation circuit 520 to bias well region 530 with a positive voltage to reduce the threshold voltage of the device's transistors. Conversely, if T_dev is less than T_ref, which may indicate that device 500 falls within the specified range of operating temperatures, compare circuit 753 de-asserts EN to cause voltage generation circuit 520 to not bias well region 530.

Note that other embodiments for performance measuring circuit 510 are possible, depending on the performance characteristic of interest for particular applications. Furthermore, two or more embodiments may be combined if multiple performance parameters are important. For instance, a performance measuring circuit may measure several difference performance parameters, and enable the voltage generation circuit if any one of the parameters, or a group of parameters, is outside an acceptable range. Furthermore, a performance measuring circuit in accordance with the present invention may measure both minimum and maximum values and assert an enable signal having an appropriate polarity to indicate whether a positive or negative bias voltage is required if the measured parameter is less than the minimum or greater than the maximum acceptable values.

For the embodiments described above with respect to FIG. 5, performance measuring circuit 510 is shown to provide EN directly to voltage generation circuit 520 and thus continuously measures the device's performance parameters to control the selective biasing of well region 530 while device 500 is in operation. For other embodiments, performance measuring circuit 510 may be enabled to generate EN after fabrication of device 500 to determine whether the device falls within the specified range of operating parameters, and thereafter disabled (e.g., before delivery to customers). For such embodiments, the logic state of EN generated by performance measuring circuit 510 may be stored in a suitable non-volatile memory element so that upon power-up of device 500 the stored value of EN is provided to voltage generation circuit 520 to selectively bias well region 530. In this manner, performance measuring circuit 510 may measure the performance parameter of device 500 to generate EN only once.

Figure 8A:
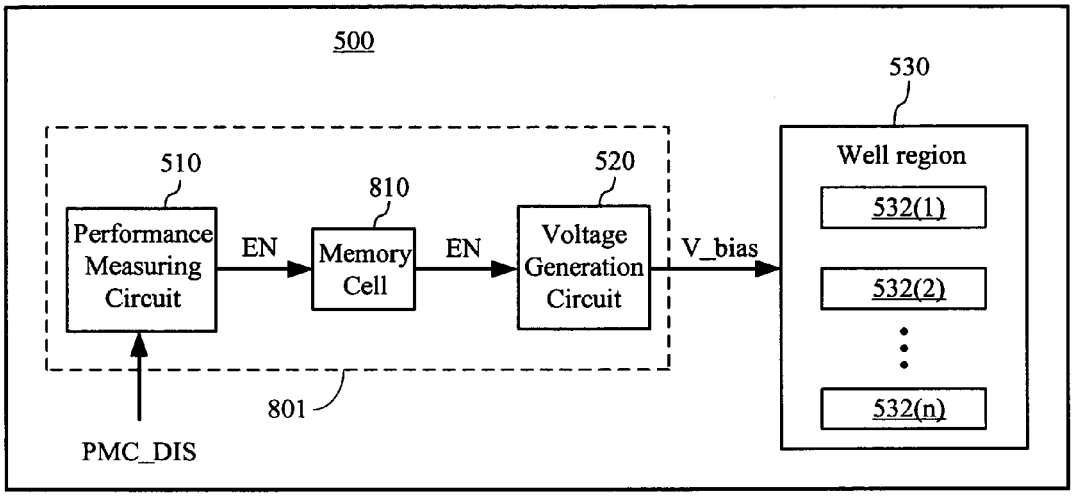
FIGS. 8A and 8B are block diagrams of a device having a control circuit configured according to another embodiment of the present invention.

For example, FIG. 8A shows device 500 as having a control circuit 801 to selectively provide a bias voltage to well region 530. In addition to the elements of control circuit 501 described above with respect to FIGS. 5 and 7A-7C, control circuit 801 includes a memory cell 810 coupled between performance measuring circuit 510 and voltage generation circuit 520. Memory cell 810 may be any suitable non-volatile memory element such as, for example, a PROM cell, an EPROM cell, an EEPROM cell, a Flash memory cell, a laser, an electrical fuse, and the like. For embodiments of FIG. 8A, performance measuring circuit 510 includes a control terminal to receive a disable signal PMC_DIS. In other embodiments, volatile memory elements, such as an SRAM or DRAM cell, may be used. In such embodiments, the performance measuring circuit may be configured to measure performance and set or update the state of the memory cell, for example, each time the circuit is powered up, or at regular predetermined intervals. Memory cell 810 may include one or more bits, depending on the number of bits in the enable signal.

An exemplary operation of control circuit 801 is as follows. After fabrication of device 500, PMC_DIS is initially de-asserted to enable performance measuring circuit 510 to generate EN, and the logic state of EN is stored in memory cell 810. Then, prior to delivering device 500 to customers, PMC_DIS is asserted to disable performance measuring circuit 510 from subsequent operation. Thereafter, upon power-up of device 500, memory cell 810 outputs EN to voltage generation circuit 520 to selectively bias well region 530 in the manner described above to compensate for process variations inherent in the fabrication of device 500. In this manner, performance measuring circuit 510 is used only once (e.g., by the IC manufacturer) to determine whether device 500 falls within the specified range of operating parameters, and thus whether to bias well region 530.

The disable signal PMC_DIS may be generated in any suitable manner. For some embodiments, the logic state of PMC_DIS is stored in a suitable non-volatile memory element (not shown for simplicity) coupled to the control input of performance measuring circuit 510. For other embodiments, PMC_DIS may be provided as an input control signal to performance measuring circuit 510 via an input pad (not shown for simplicity) of device 500.

Figure 8B:
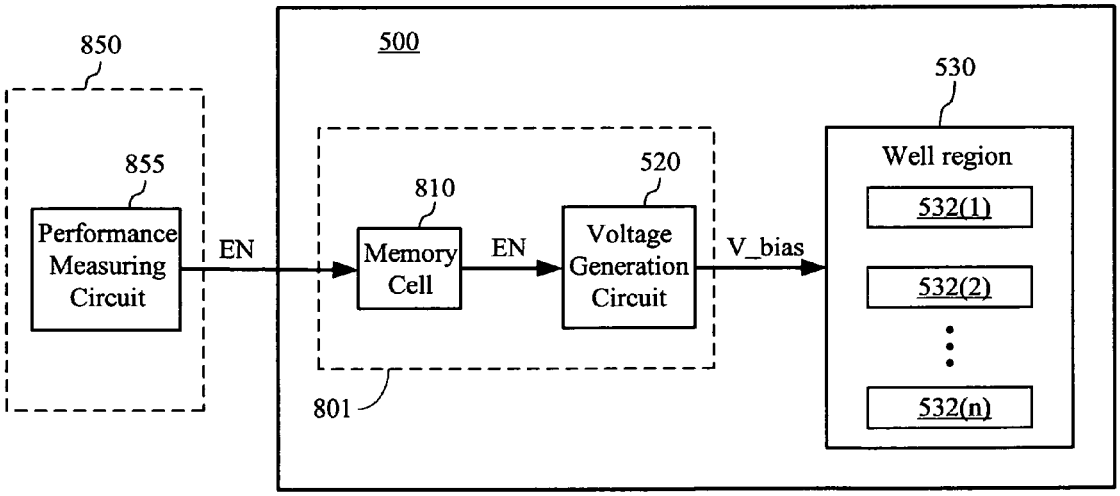

For other embodiments, as shown in FIG. 8B, circuitry external to device 500 may be used to measure performance parameters of the device to determine whether the device is within the specified range of operating parameters, and in response thereto EN may be provided as an input signal to device 500 via a corresponding input pad (not shown) for storage in memory cell 810. For such embodiments, performance measuring circuit 510 may be eliminated from device 500. That is, an external performance measuring circuit 855 may provide an enable signal EN to a control circuit 801 including a memory cell 810 and a voltage generation circuit 520. In accordance with the present invention, the external performance measuring circuit 855 may be used to measure one or more performance parameters and generate the enable signal based on the performance parameters measured. The enable signal may then be stored in a memory cell 810. In some instances, performance measuring circuit 855 may be part of a test system 850. The test system 850 may be a conventional tester used by a manufacturer to test integrated circuits during the fabrication process. An external performance measuring circuit advantageously allows a single measuring circuit to be used with a number of different devices. In some embodiments, the performance parameters to be measured may already be part of the test suite for device 500, and thus making the measurement advantageously incurs no additional test time.

As mentioned above, embodiments of the present invention are equally applicable for adjusting the VT of PMOS transistors formed in an n-well region of a semiconductor device to compensate for process variations inherent in the fabrication of semiconductor devices. For such embodiments, the polarity of the bias voltage applied to an n-well region is opposite of that described above with respect to p-well region 530 of device 500. For example, if a device having PMOS transistors formed in an n-well region of the device is a fast device having a leakage current that exceeds a maximum specified leakage current, control circuit 501 may be configured to bias the n-well region with a positive bias voltage to increase the absolute value of the threshold voltage |VT| of the PMOS transistors formed therein to recover the fast device by reducing its leakage current. Conversely, if the device having PMOS transistors is a slow device having a propagation delay that exceeds a maximum specified propagation delay, control circuit 501 may configured to bias the n-well region with a negative bias voltage to decrease the |VT| of the PMOS transistors formed therein to recover the slow device by reducing its propagation delay. Note that n-well regions are typically referenced to power supply (e.g., VDD), and thus the bias applied may also be referenced to VDD, as will be readily understood by one of ordinary skill in the art.

Figure 9:
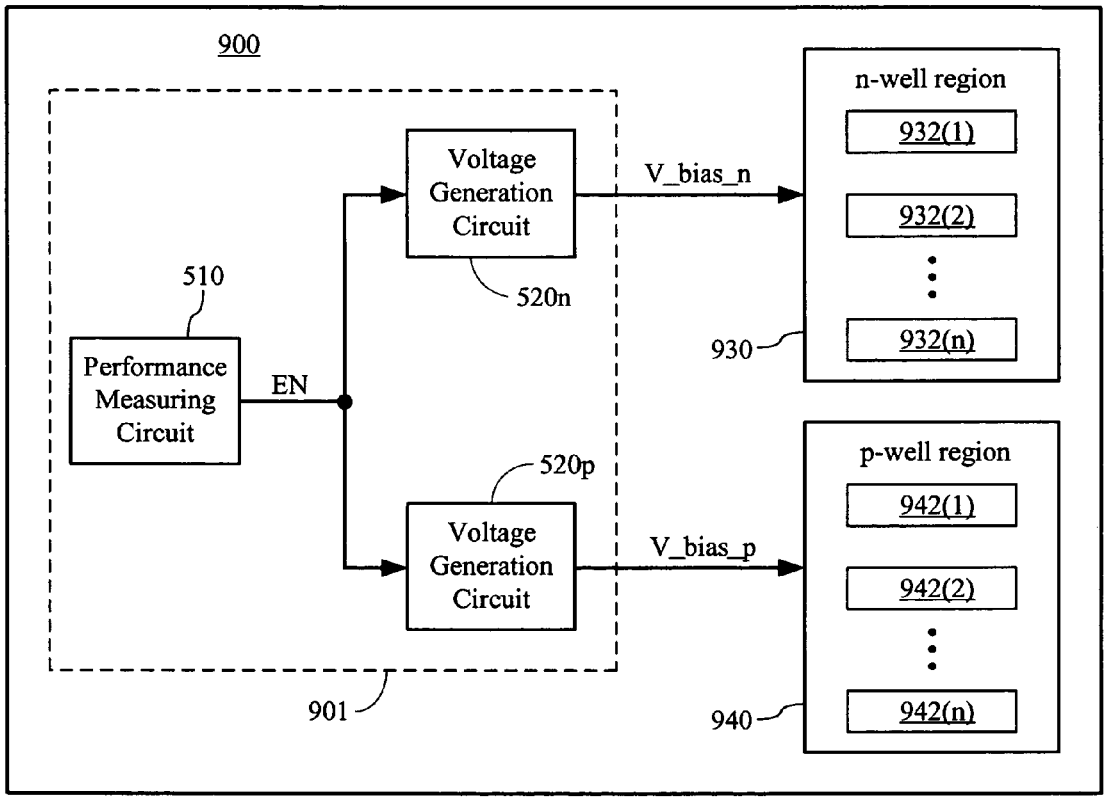
FIG. 9 is a block diagram of a device having a control circuit configured to bias an n-well region and a p-well region in accordance with the present invention.

Embodiments of the present invention may also be employed to compensate for process variations in devices having both PMOS and NMOS transistors. For example, FIG. 9 shows a device 900 having a control circuit 901, an n-well region 930 having a plurality of PMOS transistors 932(1)-932(*n*) formed therein, and a p-well region 940 having a plurality of NMOS transistors 942(1)-942(*n*) formed therein. For simplicity, only one n-well region 930 and only one p-well region 940 are shown in FIG. 9. However, for other embodiments, device 900 may include any number of n-well regions 930 and p-well regions 940.

Transistors 932 and 942, which may be any well-known PMOS and NMOS transistor devices, respectively, may perform any suitable function and/or may form any suitable circuit element. For example, transistors 932 and/or 942 may be pass or select transistors, or may form more complex circuits such as logic gates, registers, latches, processors, configurable logic blocks in a PLD, and the like. For other embodiments, transistors 932 and/or 942 may be floating gate transistors used to form well-known non-volatile memory elements such as EPROM, EEPROM, and Flash memory cells.

Control circuit 901, which is another embodiment of control circuit 501 of FIG. 5, includes performance measuring circuit 510, a first voltage generation circuit 520*n*, and a second voltage generation circuit 520*p*. Performance measuring circuit 510 measures a performance parameter of device 900 to generate EN in a manner similar to that described above with respect to FIGS. 5 and 7A-7C. Voltage generation circuit 520*n* includes an input to receive EN and an output to selectively provide a bias voltage V_bias_n to n-well region 930, and voltage generation circuit 520*p* includes an input to receive EN and an output to selectively provide a bias voltage V_bias_p to p-well region 940. Voltage generation circuits 520*n* and 520*p* are well-known circuits that selectively output desired bias voltages in response to EN.

For first embodiments of FIG. 9, performance measuring circuit 510 may be configured to assert EN if device 900 is a fast device (e.g., such as indicated by devices represented by "x" in FIG. 6), and may be configured to de-assert EN if device 900 is not a fast device. For example, if EN is asserted, voltage generation circuit 520*n* may provide a positive bias voltage to n-well region 930 to increase the |VT| of PMOS transistors 932, and voltage generation circuit 520*p* may provide a negative bias voltage to p-well region 940 to increase the VT of NMOS transistors 942, thereby altering the operating characteristics of transistors 932 and 942 so that device 900 falls within the specified range of operating parameters. Conversely, if EN is de-asserted, voltage generation circuits 520*n* and 520*p* may not provide bias voltages to n-well region 930 and p-well region 940, respectively.

For second embodiments of FIG. 9, performance measuring circuit 510 may be configured to assert EN if the device is a slow device (e.g., such as indicated by devices represented by "*" in FIG. 6), and may be configured to de-assert EN if device 900 is not a slow device. For example, if EN is asserted, voltage generation circuit 520*n* may provide a negative bias voltage to n-well region 930 to decrease the |VT| of PMOS transistors 932, and voltage generation circuit 520*p* may provide a positive bias voltage to p-well region 940 to decrease the VT of NMOS transistors 942, thereby altering the operating characteristics of transistors 932 and 942 so that device 900 falls within the specified range of operating parameters. Conversely, if EN is de-asserted, voltage generation circuits 520*n* and 520*p* may not provide bias voltages to n-well region 930 and p-well region 940, respectively.

Figure 10:
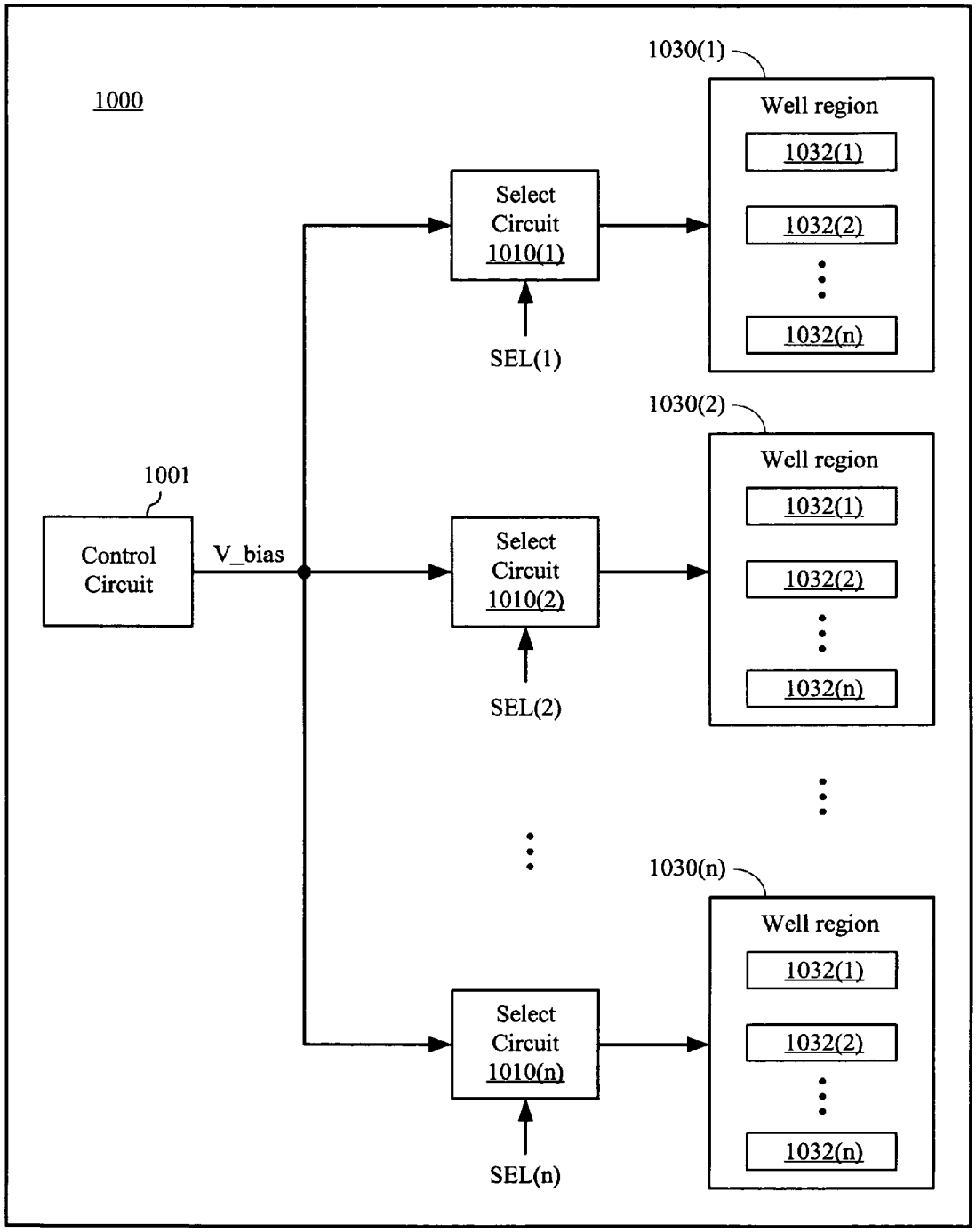
FIG. 10 is a block diagram of a device having a control circuit configured to selectively bias one or more selected well regions in accordance with another embodiment of the present invention.

For other embodiments, the control circuits described above may be configured to selectively provide a bias voltage to one or more selected well regions of a semiconductor device. For example, FIG. 10 shows a semiconductor device 1000 having a plurality of well regions 1030(1)-1030(*n*), each housing any number of transistors 1032(1)-1032(*n*). Device 1000, which may be any suitable semiconductor device such as a PLD, includes a control circuit 1001 and a plurality of select circuits 1010(1)-1010(*n*). Control circuit 1001, which is another embodiment of control circuit 501 of FIG. 5, generates V_bias in a manner similar to that described above. Each select circuit 1010 includes a first input to receive V_bias, a second input to receive a corresponding select signal SEL, and an output coupled to a corresponding well region 1030. Select circuits 1010(1)-1010(*n*) may be any well-known circuits that selectively pass V_bias to corresponding well regions 1030(1)-1030(*n*) in response to SEL (1)-SEL(n), respectively. For example, if SEL(1) is asserted, select circuit 1030(1) biases well region 1030(1) with V_bias, and conversely, if SEL(1) is de-asserted, select circuit 1030 (1) does not bias well region 1030(1) with V_bias.

The select signals SEL may be generated in any suitable manner. For some embodiments, the select signals are stored in a plurality of corresponding non-volatile memory elements (not shown for simplicity) such as PROM cells, EPROM cells, EEPROM cells, flash memory cells, a laser, and/or an electrical fuse. For one embodiment, the select signals SEL may be provided to device 1000 via suitable input pads (not shown for simplicity) of device 1000 for storage in the corresponding non-volatile memory cells. For other embodiments, the select signals SEL may be provided directly to the select circuits 1030 from corresponding input pads.

The ability to provide a bias voltage to one or more selected well regions of a semiconductor device may be advantageous for applications in which some portions of the device are more susceptible to process variations than other portions of the device. For example, for embodiments in which device 1000 is a PLD, it may be desirable to selectively bias only the well regions housing transistors having minimal geometries (e.g., high speed transistors that form core elements of the PLD such as configurable logic blocks) which are particularly susceptible to process variations, and to not bias other well regions housing longer gate transistors (e.g., high voltage transistors that form input/output blocks of the PLD) which are relatively insensitive to process variations.

Figure 11:
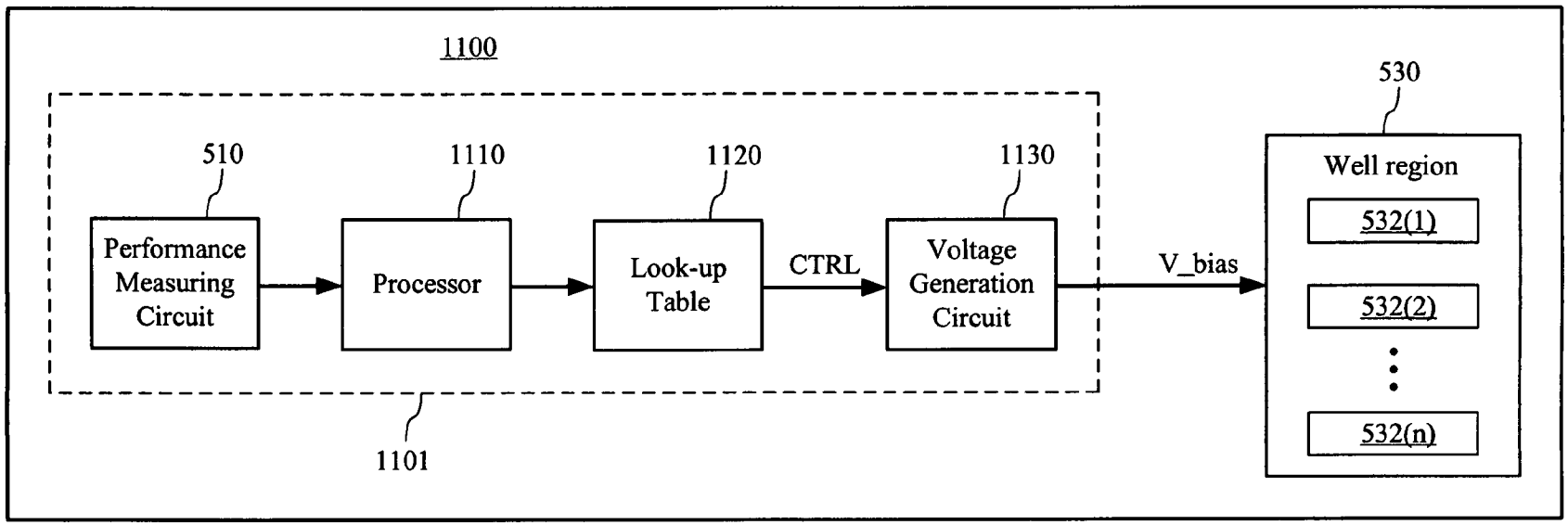
FIG. 11 is a block diagram of a device having a control circuit configured to adjust a well bias voltage in accordance with another embodiment of the present invention.

The embodiments described above selectively provide a predetermined bias voltage to one or more well regions of a semiconductor device. However, other embodiments of the present invention may be configured to adjust the well bias voltage in response to the measured performance parameter to compensate for process variations. For example, FIG. 11 shows a device 1100 having a control circuit 1101 that is another embodiment of control circuit 501 of FIG. 5. Device 1100 may be any suitable semiconductor device such as a PLD. Control circuit 1101 includes performance measuring circuit 510, a processor 1110, a look-up table 1120, and a voltage generation circuit 1130. Look-up table 1120, which may be any suitable storage element including, for example, a content addressable memory (CAM) device, stores information embodying a predetermined relationship between the measured performance parameter and the well bias voltage.

In operation, performance measuring circuit 510 measures a performance parameter of device 1100 in a manner similar to that described above, and then provides a signal indicative of the measured performance parameter to look-up table 1120 via processor 1110, which may be any suitable processor. For other embodiments, processor 1110 may be eliminated. In response to the performance parameter signal generated by performance measuring circuit 510, look-up table 1120 outputs a control signal CTRL indicative of a particular well bias voltage corresponding to the measured performance parameter. In response to CTRL, voltage generation circuit 1130, which may be any well-known circuit that generates an output voltage adjustable in response to an input signal such as CTRL, generates V_bias for well region 530. In this manner, embodiments of FIG. 11 may adjust the well bias voltage in response to measured performance parameters to more precisely control the VT of transistors formed in well region 530, thereby increasing the precision with which the operating characteristics of transistors 532 may be altered.

While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention. For example, for other embodiments, the control circuits of the present invention may be configured to adjust a supply voltage of a semiconductor device in response to the measured performance parameter to sufficiently alter the operating characteristics of the device's transistors so that the device falls within the specified range of operating parameters. Thus, additional embodiments of the present invention may be configured to measure other parameters of the device to determine whether the device falls within a specified range of operating parameters, and thus whether to bias one or more well regions of the device to alter the operating characteristics of the transistors formed therein. For one example, the performance measuring circuit may be configured to determine the resistance of one or more selected resistive elements in the device and compare the measured resistance to a reference value to generate the enable signal that controls the bias voltage generation circuit. For another example, the performance measuring circuit may be configured to determine the capacitance of one or more selected capacitive elements in the device and compare the measured capacitance to a reference value to generate the enable signal that controls the bias voltage generation circuit. Furthermore, in some embodiments, the threshold voltages may be adjusted such that the threshold voltage of PMOS transistors is substantially balanced with the threshold voltage of NMOS transistors. That is, the range of desired operating parameters may include having PMOS and NMOS transistors with balanced threshold voltages, thereby implying that their respective switching levels are equalized. This may be especially advantageous for certain types of circuits, such as pass gates, transmission gates, and charge pumps.

What is claimed is:

1. A method of compensating for process variations in a fabrication of a semiconductor device having a plurality of transistors formed in any number of well regions of the device, the method comprising:

determining whether the device falls within a specified range of operating parameters, wherein the determining comprises:

measuring a performance parameter of the device;

comparing the performance parameter to a reference value; and generating an enable signal in response to the comparing;

selectively biasing one or more of the well regions with a bias voltage in response to the enable signal to alter one or more operating characteristics of the transistors to cause the device to fall within the specified range of operating parameters; and storing the enable signal in a memory.

2. The method of claim 1, further comprising:

generating a number of select signals; and selectively providing the bias voltage to the one or more well regions in response to corresponding select signals.

3. The method of claim 1, further comprising:

adjusting the bias voltage according to a predetermined relationship between the performance parameter and the bias voltage.

4. The method of claim 3, further comprising:

storing the predetermined relationship in a look-up table.

5. The method of claim 1, wherein the memory is a non-volatile memory.

6. The method of claim 1, wherein the enable signal is a multi-bit signal.

7. The method of claim 1, wherein the performance parameter comprises a leakage current of the device.

8. The method of claim 7, wherein the transistors comprise NMOS transistors, and the selectively biasing comprises:

applying a negative bias voltage to the one or more well regions if the leakage current is greater than a reference value.

9. The method of claim 7, wherein the transistors comprise PMOS transistors, and the selectively biasing comprises:

applying a positive bias voltage to the one or more well regions if the leakage current is greater than a reference value.

10. The method of claim 1, wherein the performance parameter comprises a propagation delay along a selected path of the device.

11. The method of claim 10, wherein the transistors comprise NMOS transistors, and the selectively biasing comprises:

applying a positive bias voltage to the one or more well regions if the propagation delay is greater than a reference value.

12. The method of claim 10, wherein the transistors comprise PMOS transistors, and the selectively biasing comprises:

applying a negative bias voltage to the one or more well regions if the propagation delay is greater than a reference value.

13. The method of claim 1, wherein the performance parameter comprises an operating frequency of the device.

14. The method of claim 13, wherein the transistors comprise NMOS transistors, and the selectively biasing comprises:

applying a positive bias voltage to the one or more well regions if the operating frequency is less than a reference value.

15. The method of claim 13, wherein the transistors comprise PMOS transistors, and the selectively biasing comprises:

applying a negative bias voltage to the one or more well regions if the operating frequency is less than a reference value.

16. The method of claim 1, wherein the performance parameter comprises an operating temperature of the device.

17. A system that compensates for process variations in a semiconductor device having a plurality of transistors formed in one or more well regions of the device, comprising:

a performance measuring circuit configured to measure a performance parameter of the device and having an output to generate an enable signal;

a voltage generation circuit having an input to receive the enable signal and having an output to selectively provide a bias voltage to the one or more well regions in response to the enable signal, wherein the bias voltage alters one or more operating characteristics of the transistors to cause the device to meet one or more specified operating parameters; and a non-volatile memory element to store the enable signal.

18. The system of claim 17, wherein the enable signal indicates whether the device falls within the one or more specified operating parameters.

19. The system of claim 17, wherein the bias voltage alters a threshold voltage of the transistors.

20. The system of claim 17, wherein the performance measuring circuit includes a control terminal to receive a disable signal.

21. The system of claim 17, wherein the voltage generation circuit is configured to adjust the bias voltage according to a predetermined relationship between the performance parameter and the bias voltage.

22. The system of claim 21, further comprising:

a look-up table to store the predetermined relationship.

23. The system of claim 17, wherein the performance measuring circuit comprises:

circuitry to generate an output signal indicative of the performance parameter; and a comparator having a first input to receive the output signal, a second input to receive a reference signal, and an output to generate the enable signal.

24. The system of claim 17, wherein the performance parameter comprises a leakage current of the device.

25. The system of claim 24, wherein the performance measuring circuit asserts the enable signal if the leakage current is greater than a reference value, and in response thereto the voltage generation circuit biases the one or more well regions to increase a threshold voltage of the transistors formed therein.

26. The system of claim 17, wherein the performance parameter comprises a propagation delay along a selected path of the device.

27. The system of claim 26, wherein the performance measuring circuit asserts the enable signal if the propagation delay of the device is greater than a reference value, and in response thereto the voltage generation circuit biases the one or more well regions to decrease a threshold voltage of the transistors formed therein.

28. The system of claim 17, wherein the performance parameter comprises an operating frequency of the device.

29. The system of claim 28, wherein the performance measuring circuit asserts the enable signal if the operating frequency is less than a reference value, and in response thereto the voltage generation circuit biases the one or more well regions to decrease a threshold voltage of the transistors formed therein.

30. The system of claim 29, wherein the performance measuring circuit comprises:

a ring oscillator having an output;

a frequency-to-voltage converter having an input coupled to the output of the ring oscillator and having an output to generate a voltage signal relative to the operating frequency; and a comparator having a first input to receive the voltage signal, a second input to receive a reference signal, and an output to generate the enable signal.

31. The system of claim 17, further comprising:

a plurality of select circuits, each having an input to receive the bias voltage, a control input to receive a corresponding select signal, and an output coupled to a corresponding well region.

32. The system of claim 17, wherein the performance parameter comprises an operating temperature of the device.

33. A system that compensates for process variations in a semiconductor device having a plurality of transistors formed in one or more well regions of the device, comprising:

an enable signal indicating whether the device falls within a specified range of operating parameters;

a voltage generation circuit having an input to receive the enable signal and having an output to selectively provide a bias voltage to the one or more well regions in response to the enable signal, wherein providing the bias voltage to the one or more well regions alters one or more operating characteristics of the transistors formed therein to ensure the device meets one or more specified operating parameters; and a memory element to store the enable signal.

* * * * *